US006142254A

United States Patent [19]

Claybaugh et al.

[11] Patent Number: 6,142,254

[45] Date of Patent: Nov. 7, 2000

[54] DECORATIVE SPEAKER COVER

[75] Inventors: David Claybaugh, Baltimore; Sean O'Brien, Greenbelt, both of Md.

[73] Assignee: Noise Cancellation Technologies, Inc., Linthicum, Md.

[21] Appl. No.: 09/226,445

[22] Filed: Jan. 6, 1999

Related U.S. Application Data

[60] Provisional application No. 60/070,685, Jan. 7, 1998.

[51] Int. Cl.[7] ..... A47B 81/06

[52] U.S. Cl. ..... 181/199; 181/141

[58] Field of Search ..... 181/148, 157, 181/169, 170, 199, 150, 141; 40/455; 52/222

[56] References Cited

U.S. PATENT DOCUMENTS

| | | | |
|---|---|---|---|
| 3,696,885 | 10/1972 | Grieg et al. | 181/199 |
| 4,926,962 | 5/1990 | Graham et al. . | |
| 4,936,410 | 6/1990 | Howell . | |
| 5,717,171 | 2/1998 | Miller et al. | 181/199 |
| 5,970,669 | 10/1999 | Livingston | 52/222 |

*Primary Examiner*—Khanh Dang

[57] ABSTRACT

A decorative speaker cover is disclosed that transforms any loudspeaker into a work of art. The decorative speaker cover of the invention consists of a sheet of material stretched across and adhered to a support frame. The sheet of material contains an artistic work like a picture, design, custom photograph, print, etc. The invention also includes methods for attaching the decorative speaker covers to a loudspeaker cabinet. The disclosed methods allow speaker covers to be readily changed.

30 Claims, 15 Drawing Sheets

DECORATIVE SPEAKER COVER

This application claims the benefit of U.S. Provisional Application No. 60/070,685 filed Jan. 7, 1998.

FIELD OF THE INVENTION

The present invention relates to covers for loudspeakers, especially those having aesthetic qualities. The invention also concerns methods for attaching a speaker cover to a loudspeaker cabinet.

BACKGROUND OF THE INVENTION

For aesthetic reasons, a cover is placed over the radiating face of a loudspeaker to conceal the loudspeaker's components. In the past, speaker covers have been made of grill cloths, foam, and sculpted materials.

A speaker cover made of sculpted materials is disclosed in U.S. Pat. No. 4,926,962 entitled Decorative Speaker Cover issued to Graham. The color and texture of the speaker cover enable a loudspeaker to blend in with the surface of a wall or ceiling it is attached to. Once the cover is in place, there is scant visible evidence of the loudspeaker.

A speaker cover made of a sheet of flaccid material is disclosed in U.S. Pat. No. 4,936,410 entitled Speaker Cover issued to Howell. The sheet of flaccid material is folded to an appropriate size and then stretched over the radiating face of a loudspeaker enclosure. Folding the sheet of material produces the required tautness.

Neither of the patents mentioned above or any other reference disclose a speaker cover that is aesthetically appealing and fits securely to a loudspeaker cabinet. The present invention provides a speaker cover that is more durable and cosmetically superior to conventional devices.

SUMMARY OF THE INVENTION

The present invention is a decorative speaker cover consisting of a sheet of material stretched across and adhered to a support frame. The sheet of material which contains an artistic work like a picture, design, customer photograph, etc. is very durable. Because the speaker cover of the invention is essentially a canvas, it transforms any loudspeaker into a work of art.

The present invention also includes methods for attaching the decorative speaker cover of the invention to a loudspeaker cabinet. The disclosed methods make changing speaker covers a simple task.

It is an object of the invention to make a speaker cover that is durable and inexpensive to fabricate.

It is another object of the invention to create a more aesthetically pleasing speaker cover.

It is yet another object of the invention to make a speaker cover that can be readily changed to match a room's decor, a person's mood, etc.

DESCRIPTION OF THE INVENTION

Figure 1:
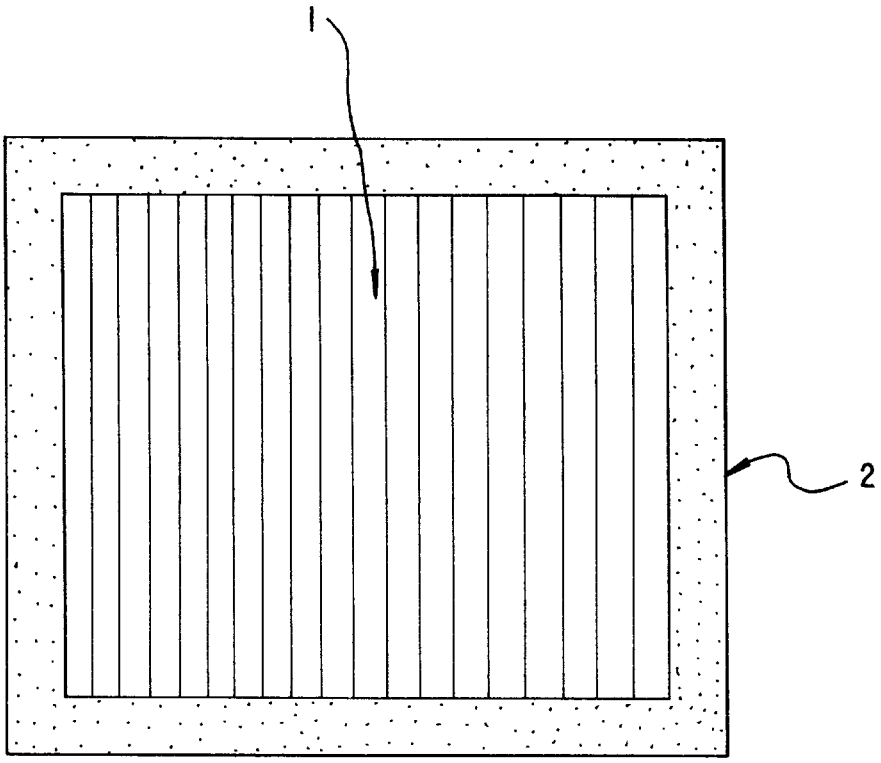
FIG. 1 shows a rear view of a decorative speaker cover according to the present invention.

FIG. 1 shows a rear view of a decorative speaker cover according to the present invention. A sheet of material 1 is stretched across and adhered to a support frame 2. The sheet of material 1 which is made of synthetic silk, ScotchPrint™ perforated vinyl film, ScotchPrint™ vinyl film, or other suitable material contains an artistic work like a picture, design, custom photograph, print, etc. The preferred material 1 has a strong, fine, uniform weave and good color adherence.

In certain applications, the sheet of material 1 should be acoustically transparent. For example, when the speaker cover will be placed over a conventional, cone shaped loudspeaker, the sheet of material 1 should be acoustically transparent so it does not distort the sound coming from the loudspeaker. In other applications, it does not matter whether the sheet of material 1 is acoustically transparent or not. For example, when the speaker cover will be placed over a loudspeaker that generates sound by moving air outside the speaker cover rather than inside the speaker cover, it is irrelevant whether the sheet 1 is acoustically transparent.

At least a portion of the periphery of the sheet of material 1 is adhered to the support frame 2. The support frame 2 is made of wood, plastic, metal, or other similar material. If desired, the support frame 2 can be placed in a picture frame.

Because the sheet of material 1 contains an artistic work, some method for transferring an image must be used. Suitable image transfer techniques include ScotchPrinting™, inkjet printing, and digital imaging techniques. The original image can come from a photograph, customized print, poster; etc.

When the sheet of material 1 is synthetic silk, the sheet 1 must be pretreated with a coating before an image can be transferred on to the sheet 1. The coating is necessary to prevent the colors in the image from running.

Figure 2:
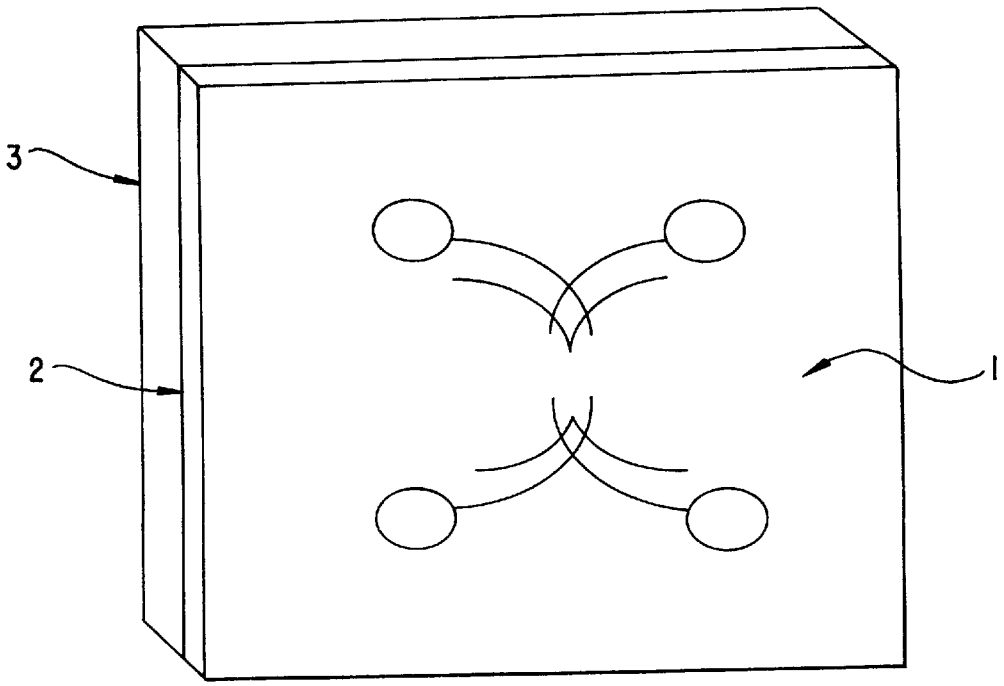
FIG. 2 illustrates a loudspeaker cabinet covered by the decorative speaker of the present invention.

FIG. 2 shows the decorative speaker cover of the invention attached to a loudspeaker cabinet 3. The present invention includes various methods for attaching the decorative speaker cover to a loudspeaker cabinet. Therefore, persons can easily change decorative covers to match their moods, the seasons, etc. When attaching a decorative speaker cover to a loudspeaker cabinet 3, a scrim cloth may be placed between the decorative speaker cover and the loudspeaker cabinet 3.

Figure 3:
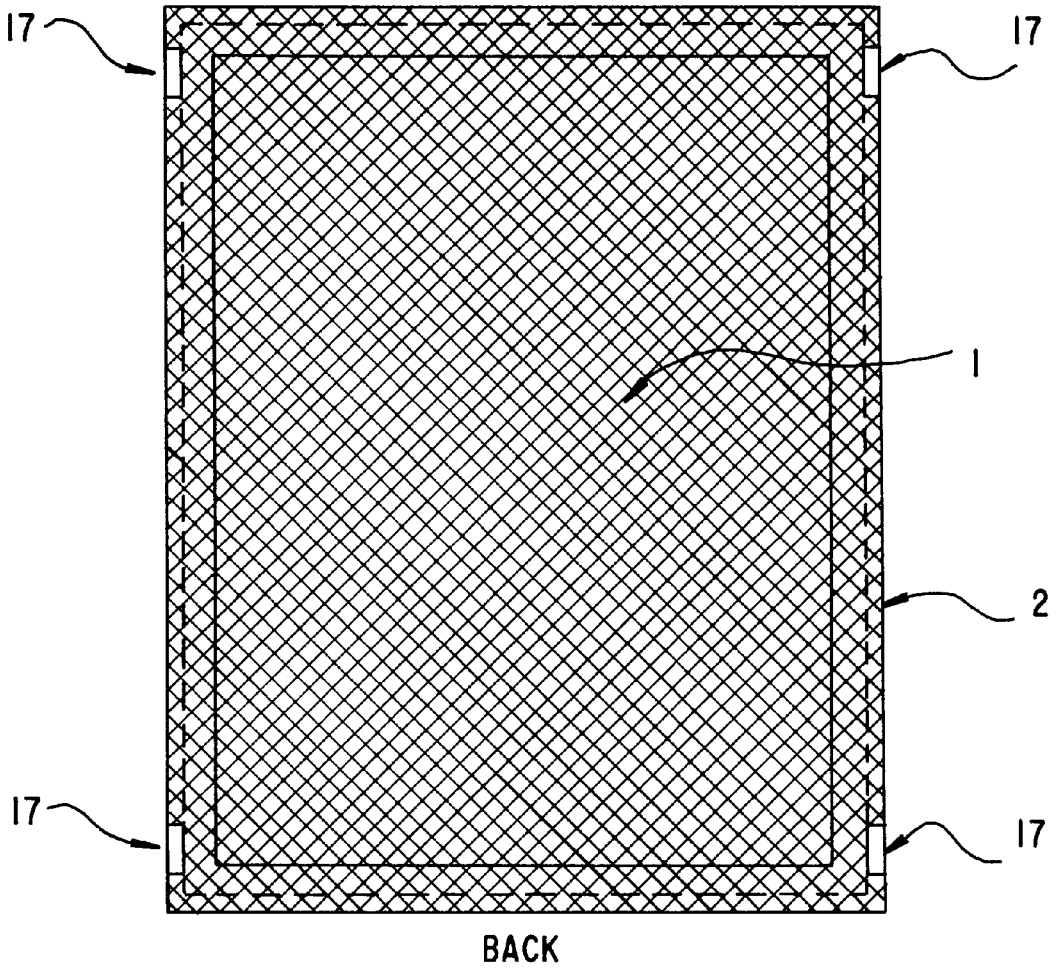
FIG. 3 shows a rear view of the decorative speaker cover according to the present invention that has metal strips placed on the support frame.
Figure 4:
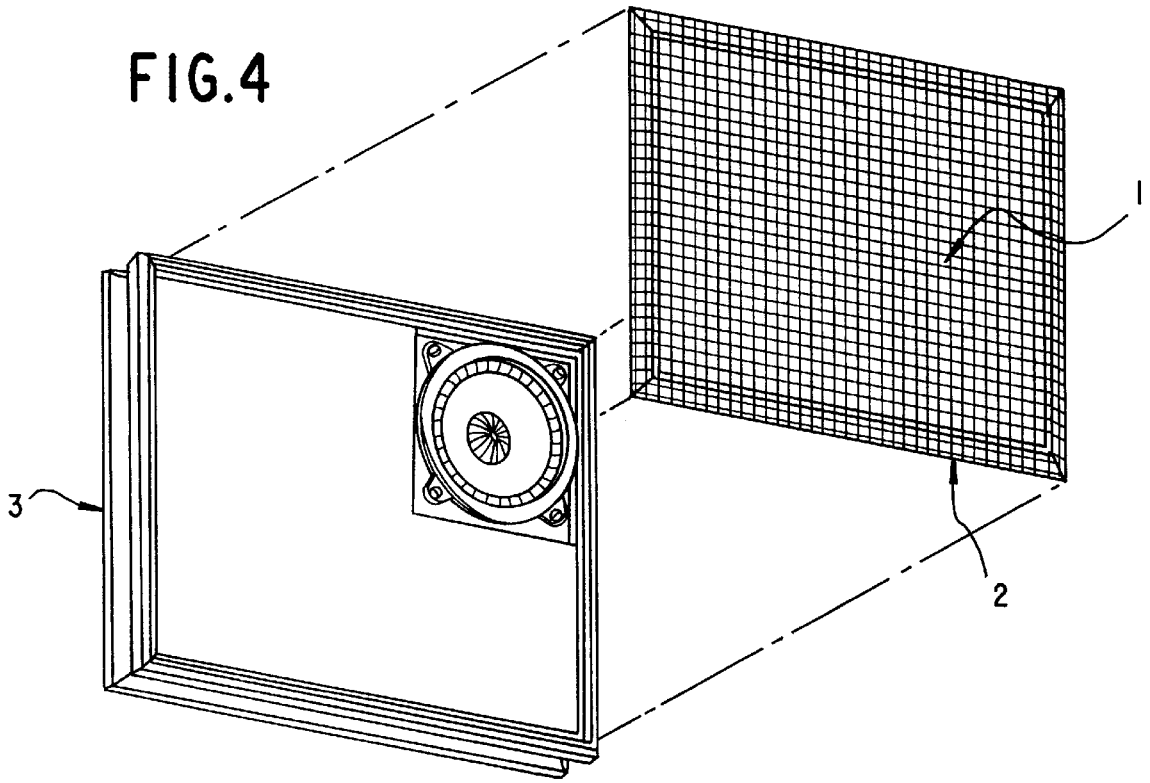
FIG. 4 illustrates one method for attaching the decorative speaker cover shown in FIG. 3 to a loudspeaker cabinet

A preferred method for attaching the decorative speaker cover of the invention to a loudspeaker cabinet 3 is illustrated in FIGS. 3 and 4. As shown in FIG. 3, metal strips 17 can be placed on the rear of the support frame 2 of the decorative speaker cover. The metal strips 17 provide an easy way to attach the decorative speaker cover to a loudspeaker cabinet 3 using the method illustrated in FIG. 4. The loudspeaker cabinet 3 includes magnets. When the metal strips 17 are in contact with the magnets, the decorative cover is secured to the cabinet 3.

Figure 5:
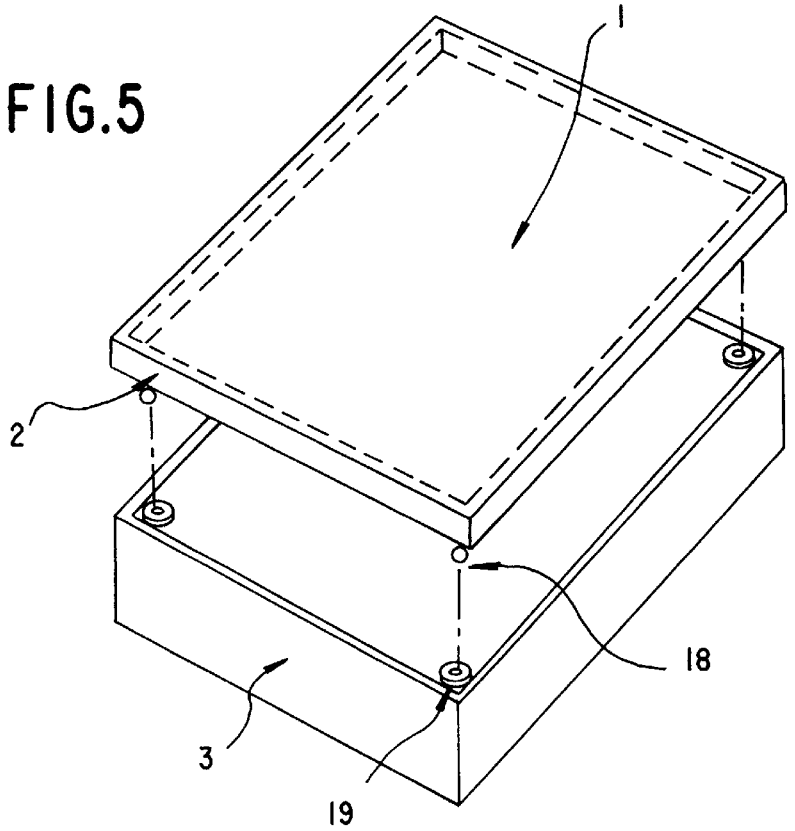
FIGS. 5–19 show various methods for attaching the decorative speaker cover of the present invention to a loudspeaker cabinet.

Other methods for attaching the decorative speaker cover of the present invention to a loudspeaker cabinet 3 are shown in FIGS. 5–19. In FIG. 5, the support frame 2 has injection molded pieces 18. The loudspeaker cabinet 3 has female receptacles 19 designed to receive the molded pieces 18. When the molded pieces 18 are pressed into the female receptacles 19, the decorative speaker cover is secured to the loudspeaker cabinet 3.

Figure 6:
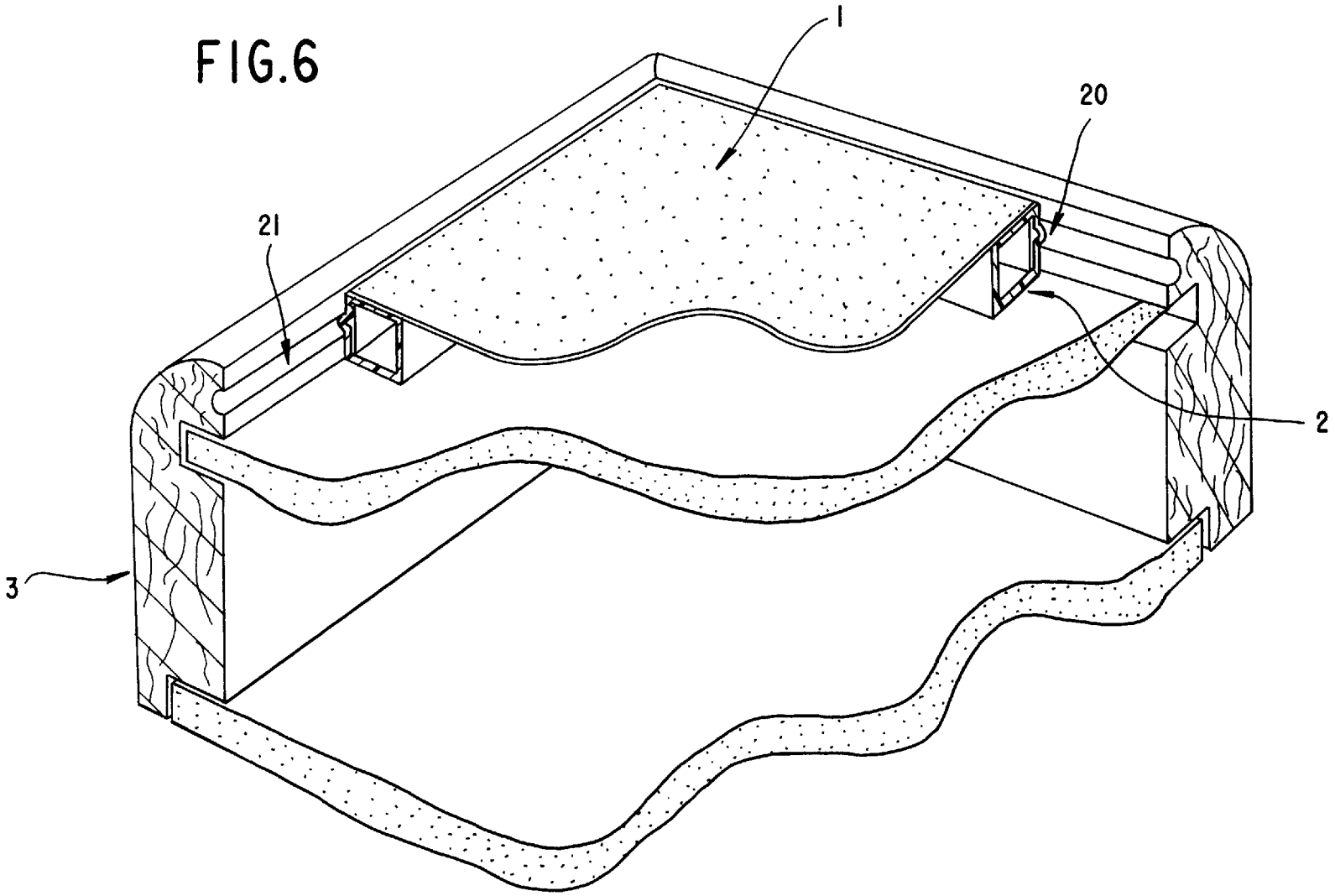

In FIG. 6, the support frame 2 includes an extruded spring 20. The loudspeaker cabinet 3 has a reveal 21. When the extruded spring 20 is pressed into the reveal 21 of the loudspeaker cabinet 3, the decorative speaker cover is secured to the loudspeaker cabinet 3.

Figure 7:
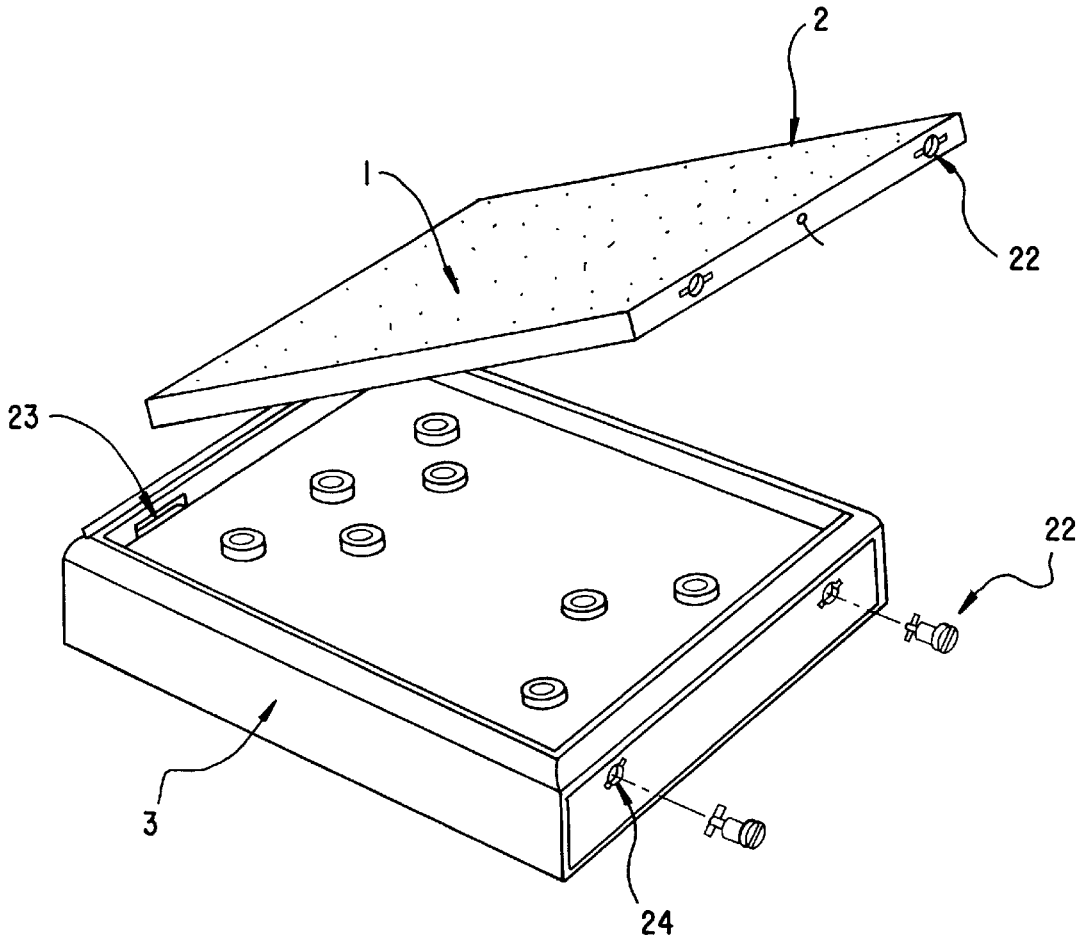

In FIG. 7, the support frame 2 includes integrated fasteners 22. The loudspeaker cabinet 3 has slots 23 that lock in the support frame 2 and holes 24 to receive the integrated fasteners 22. When the speaker cover is appropriately placed in the loudspeaker cabinet 3 and the fasteners 22 are turned, the decorative speaker cover is secured to the loudspeaker cabinet 3.

Figure 8:
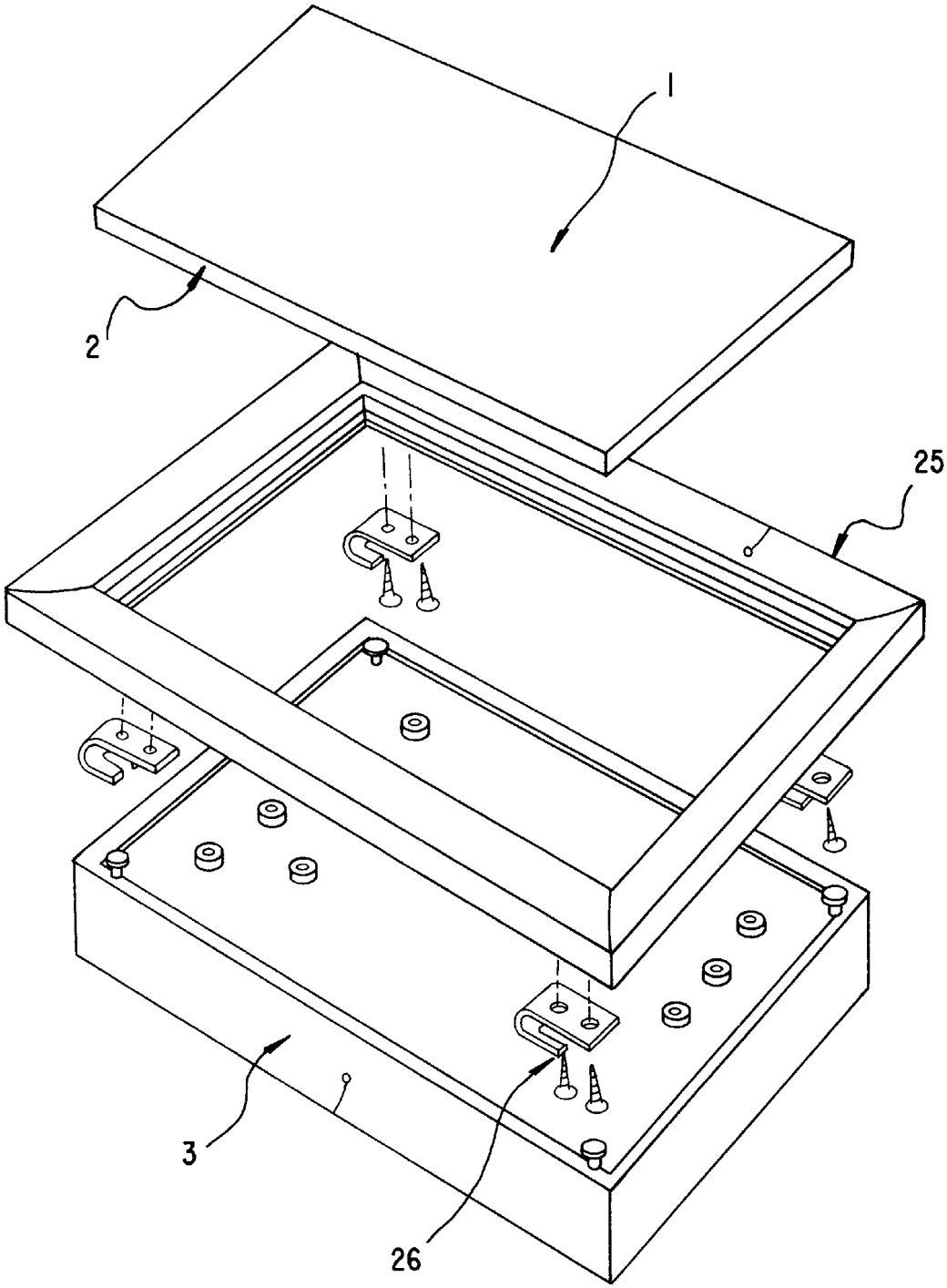
Figure 9:
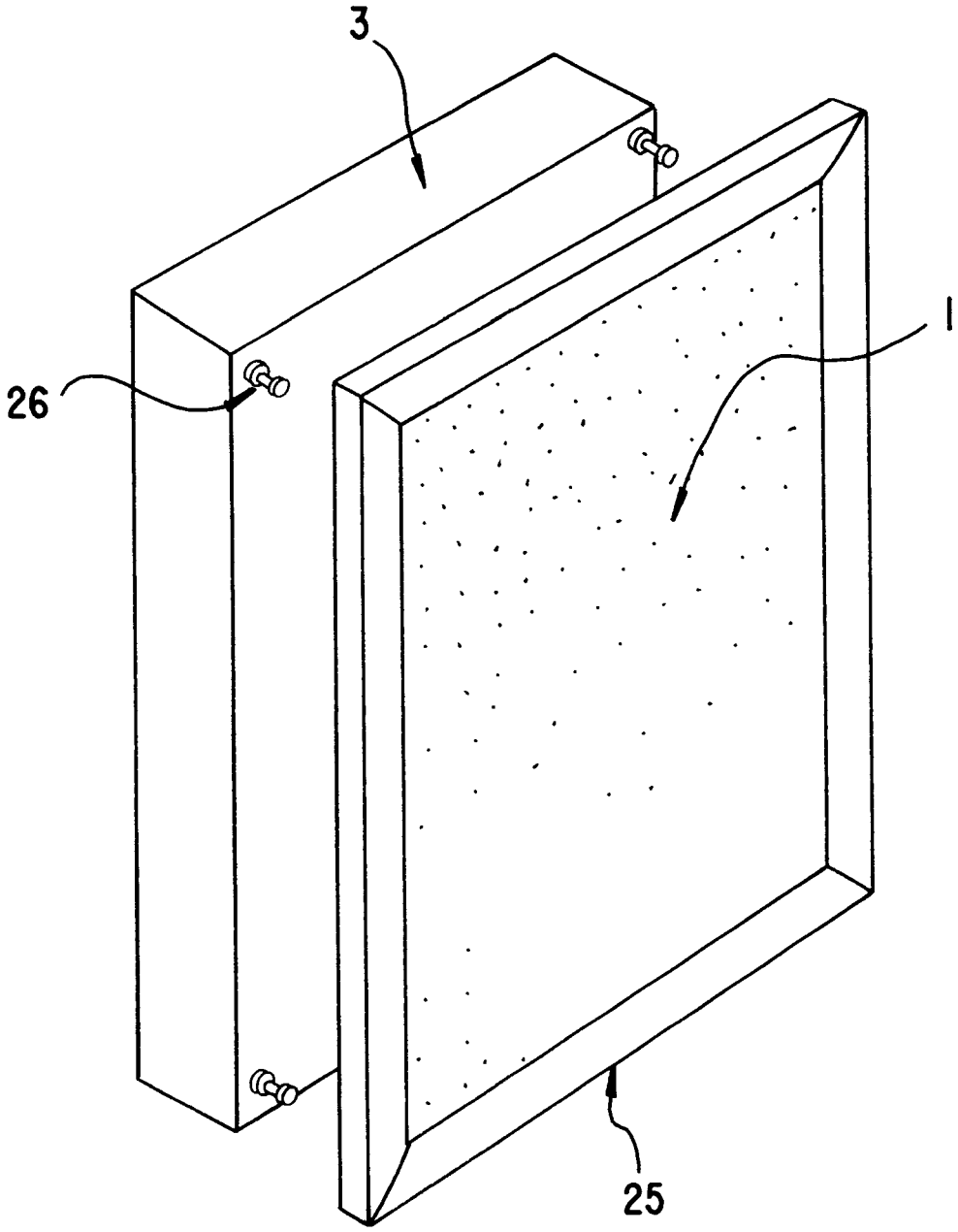
Figure 10:
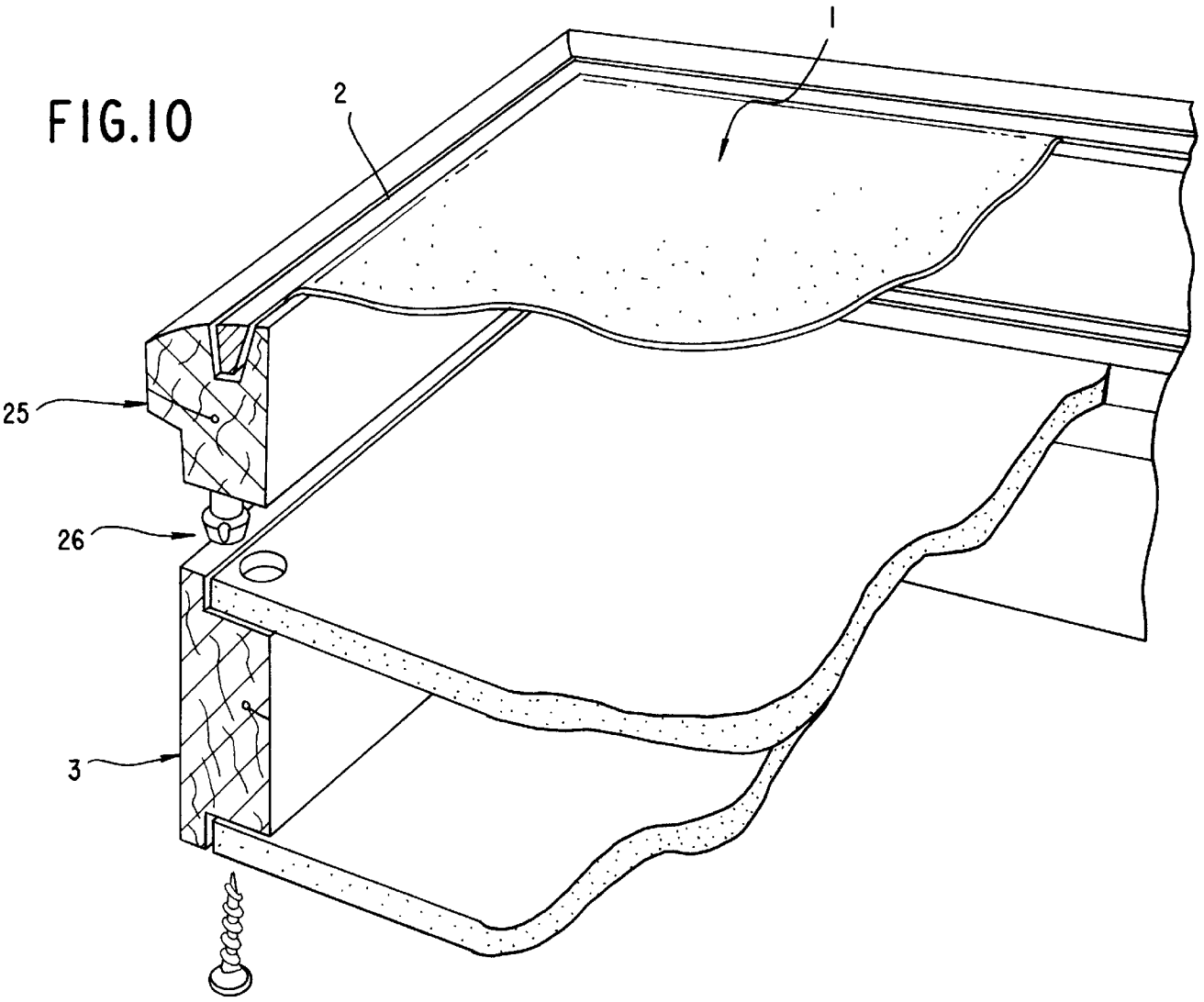
Figure 11:
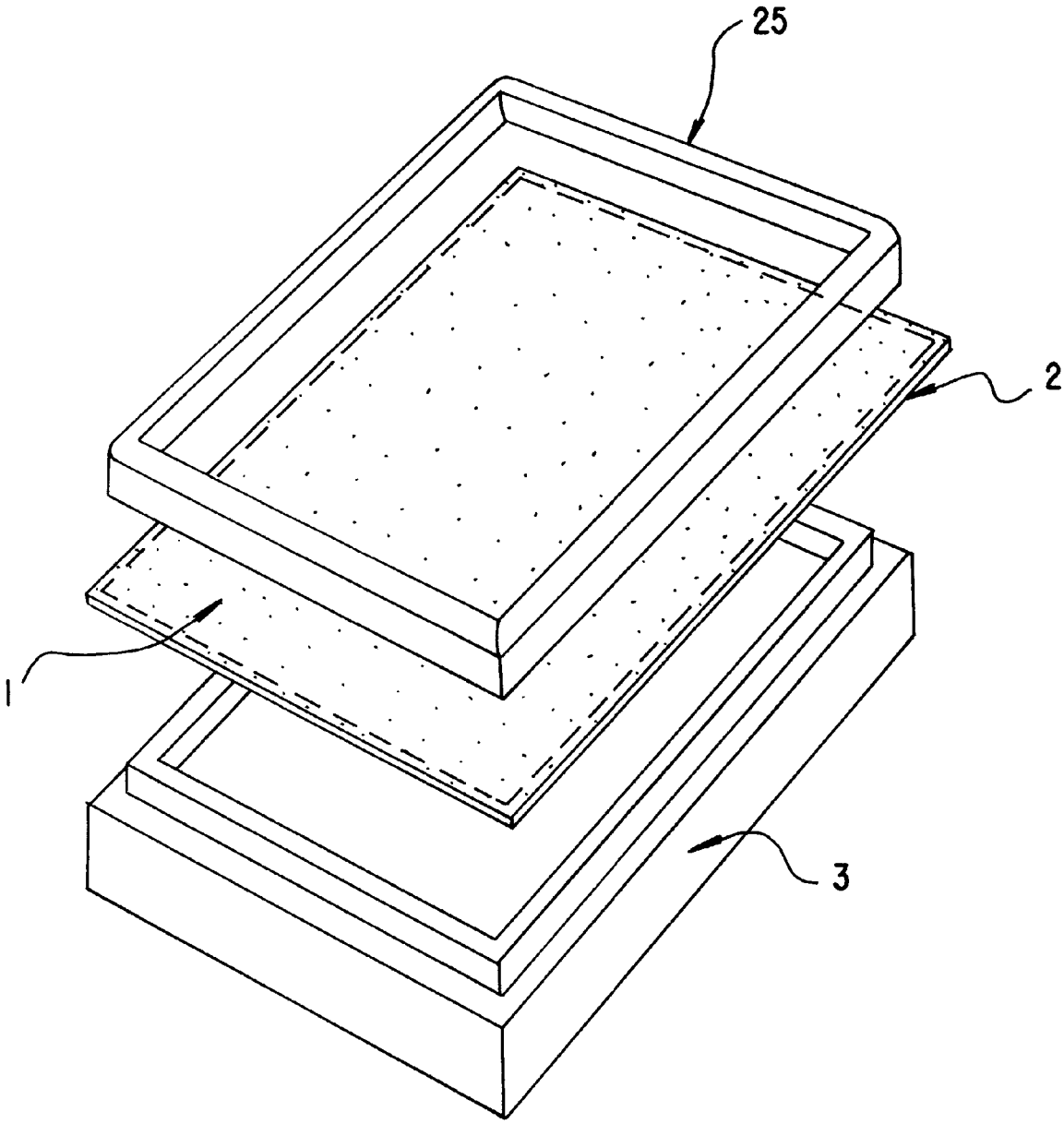
Figure 12:
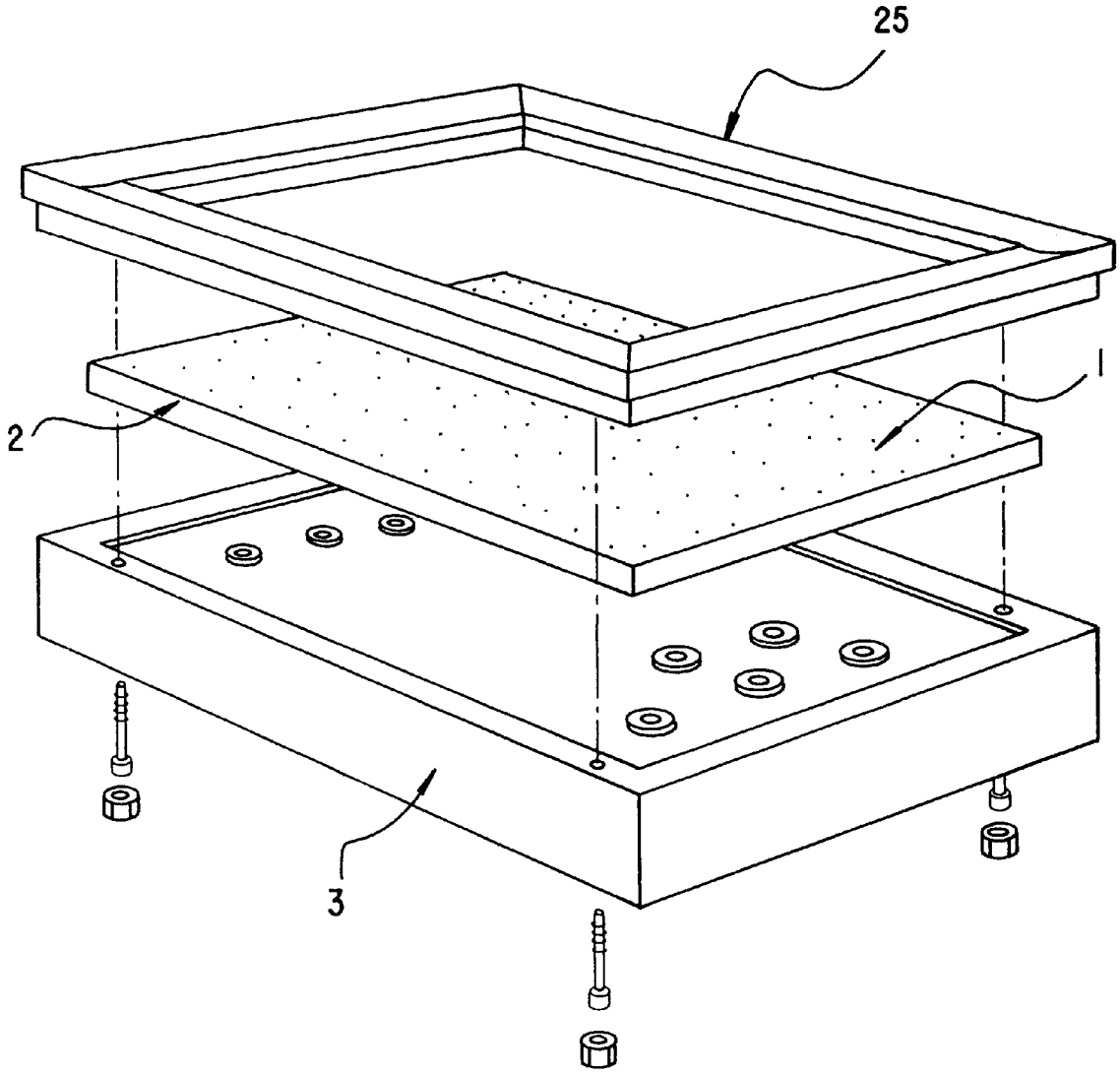

In FIGS. 8, 9, and 10, the support frame 2 is pressed into a picture frame 25. When the picture frame 25 is attached to the cabinet 3 using a fastening mechanism 26, the speaker cover is secured to the loudspeaker cabinet 3.

FIGS. 11, 12, 15, and 16 show similar ways to secure the speaker cover to the loudspeaker cabinet 3. All of the methods encompass sandwiching the speaker cover between the loudspeaker cabinet 3 and the picture frame 25. When the picture frame 25 is attached to the cabinet 3, the assembly is secure.

Figure 14:
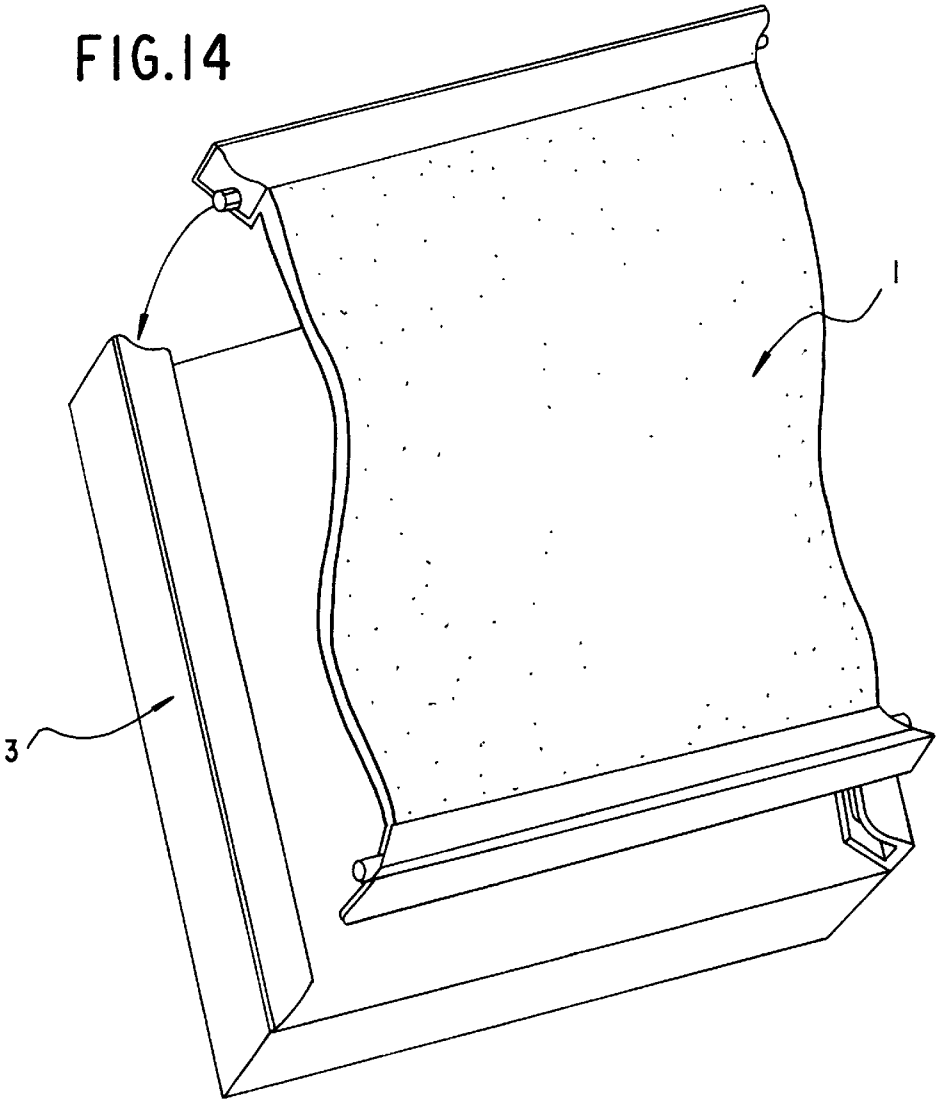
Figure 13:
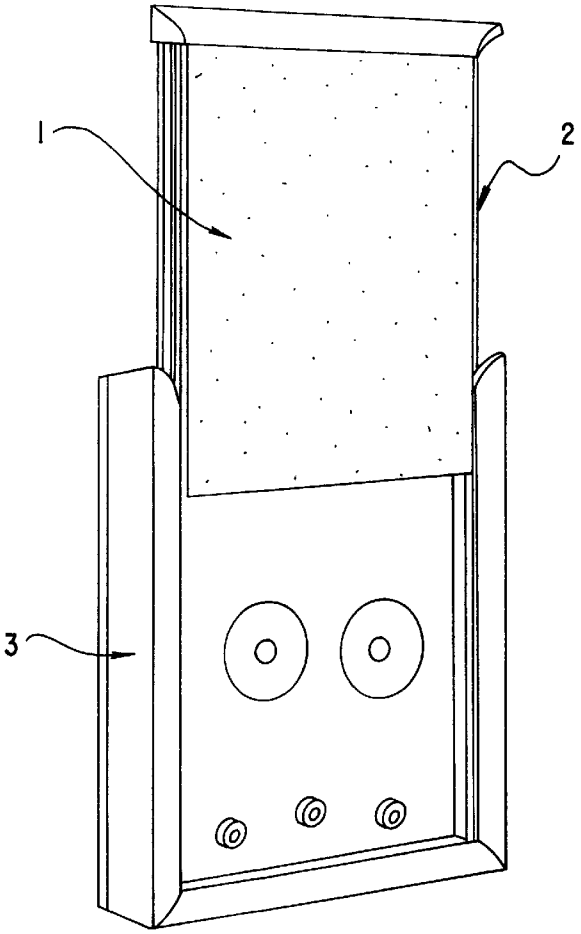
Figure 15:
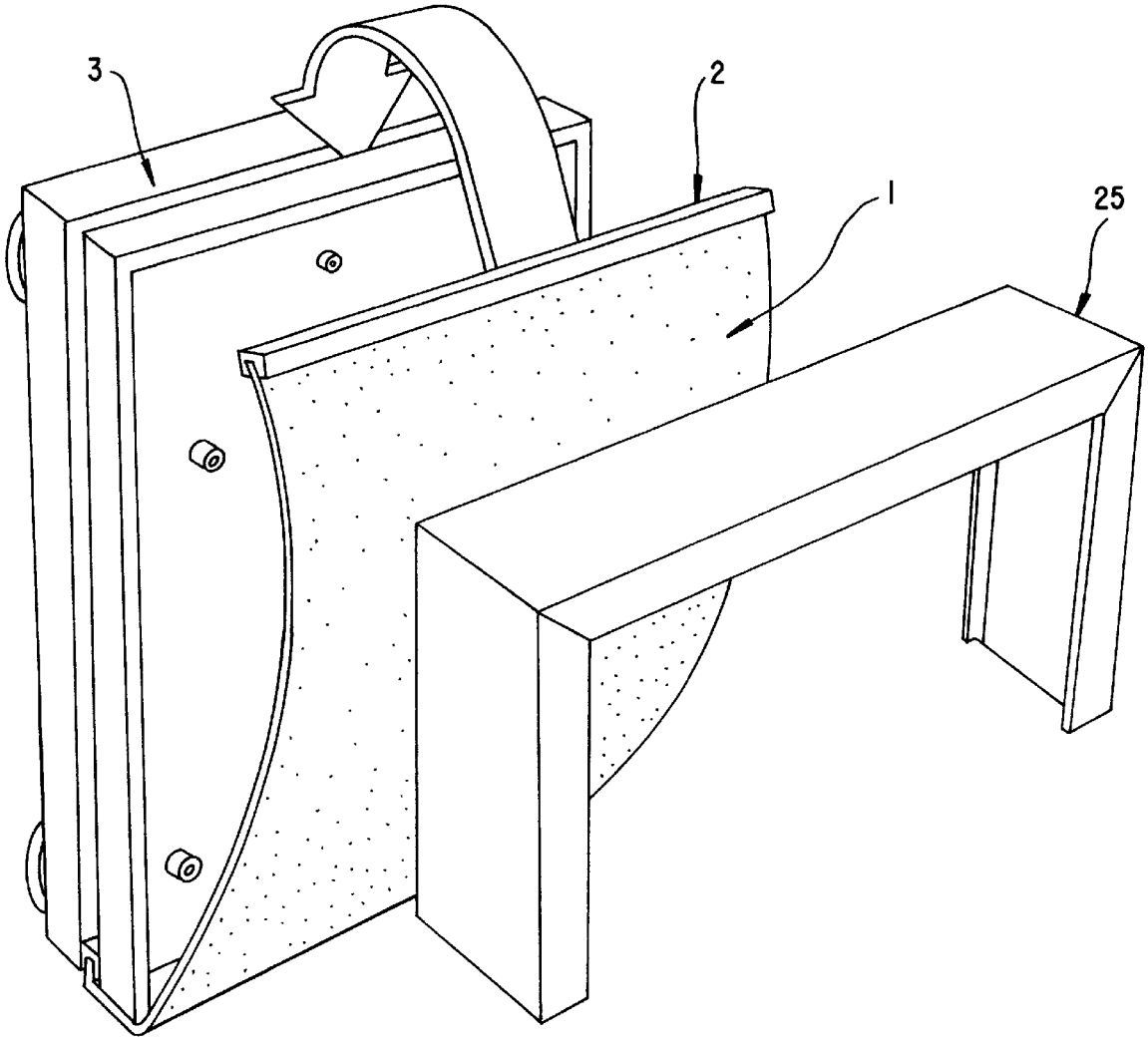
Figure 16:
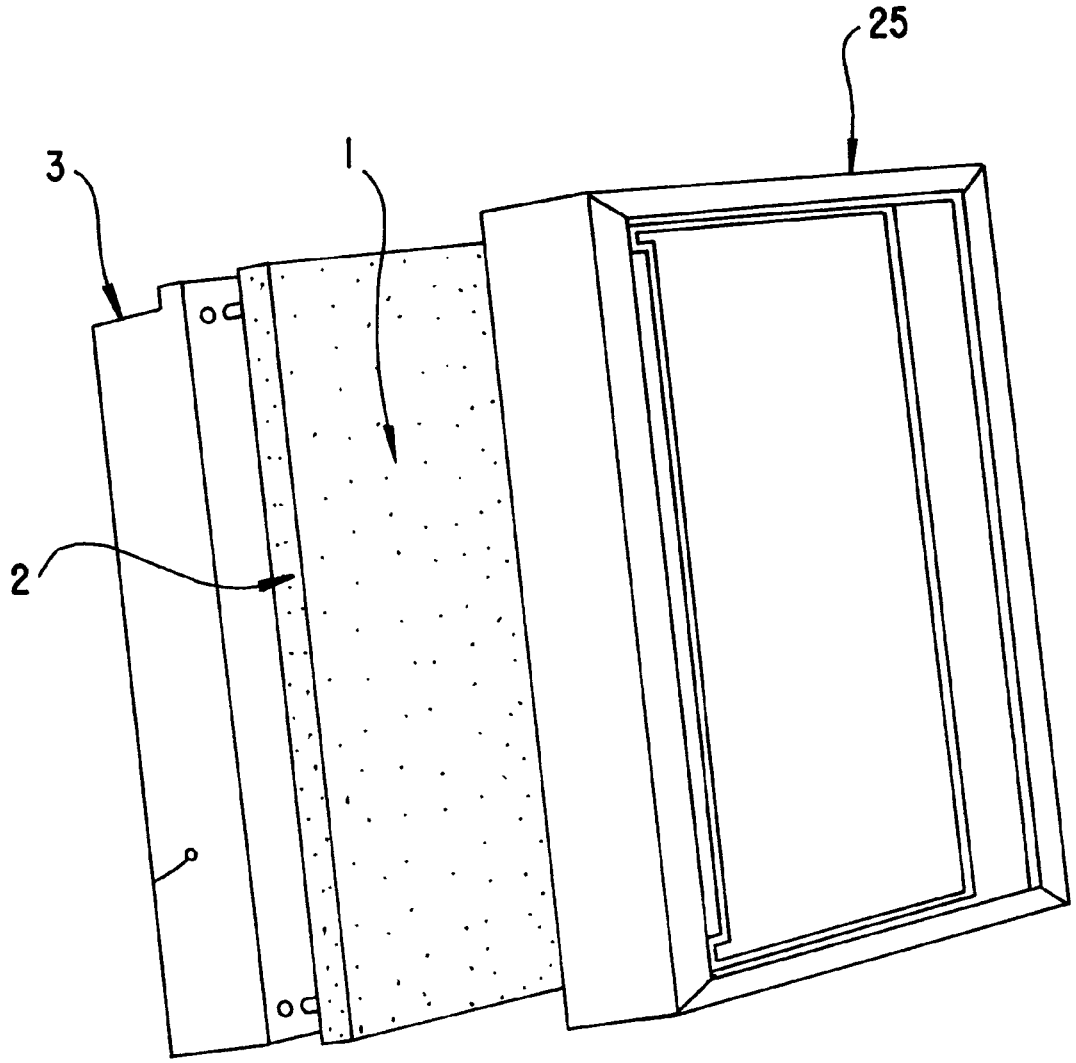

In FIGS. 13 and 14, the picture frame 25 is integrated into the loudspeaker cabinet 3. There is a removable portion of the integrated picture frame/cabinet structure that attaches to the speaker cover. When the removable portion of the integrated picture frame/cabinet structure with the picture cover is pressed into the main body of the integrated picture frame/cabinet structure, the speaker cover is secured to the loudspeaker cabinet 3.

Figure 17:
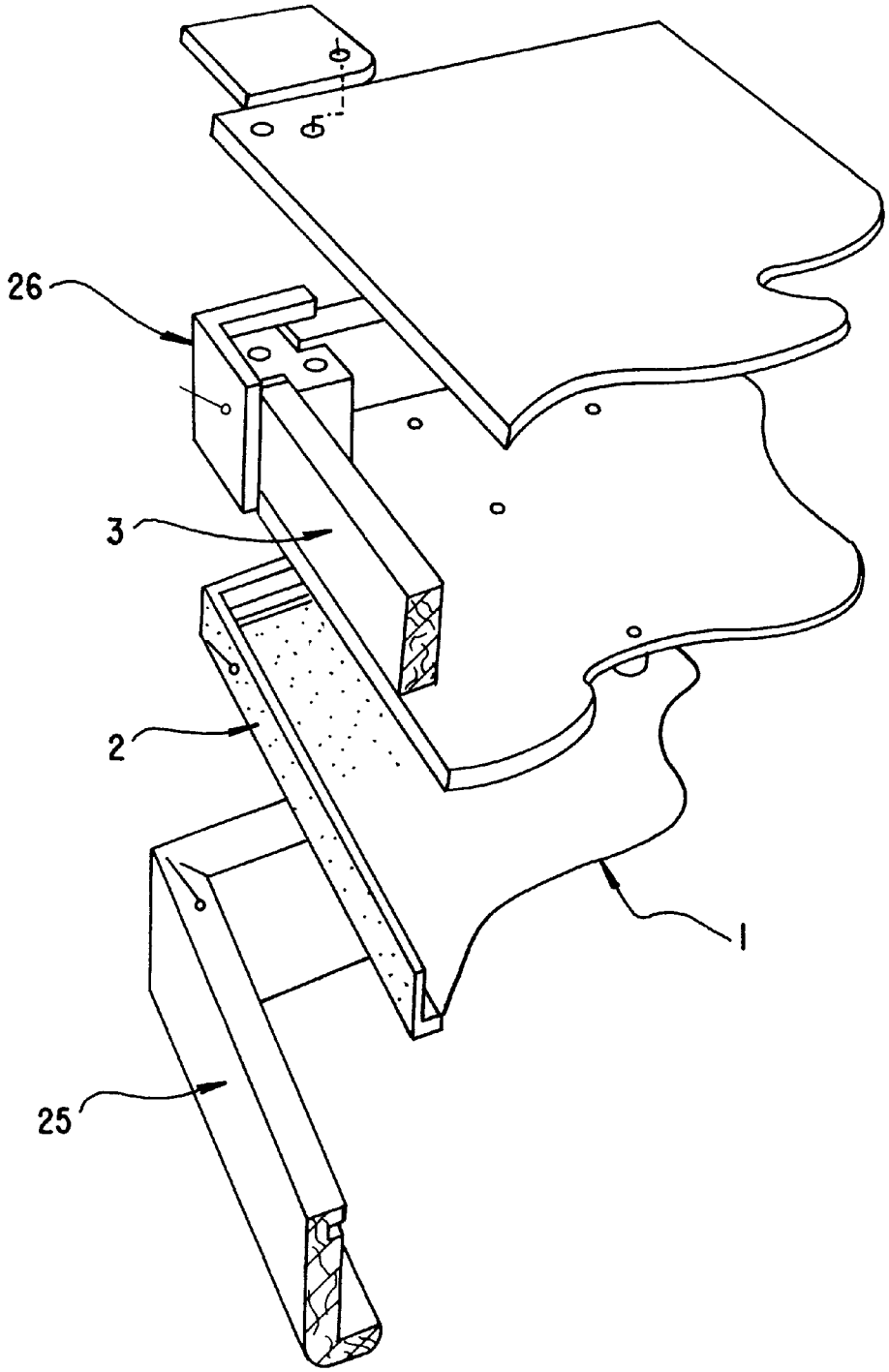
Figure 19:
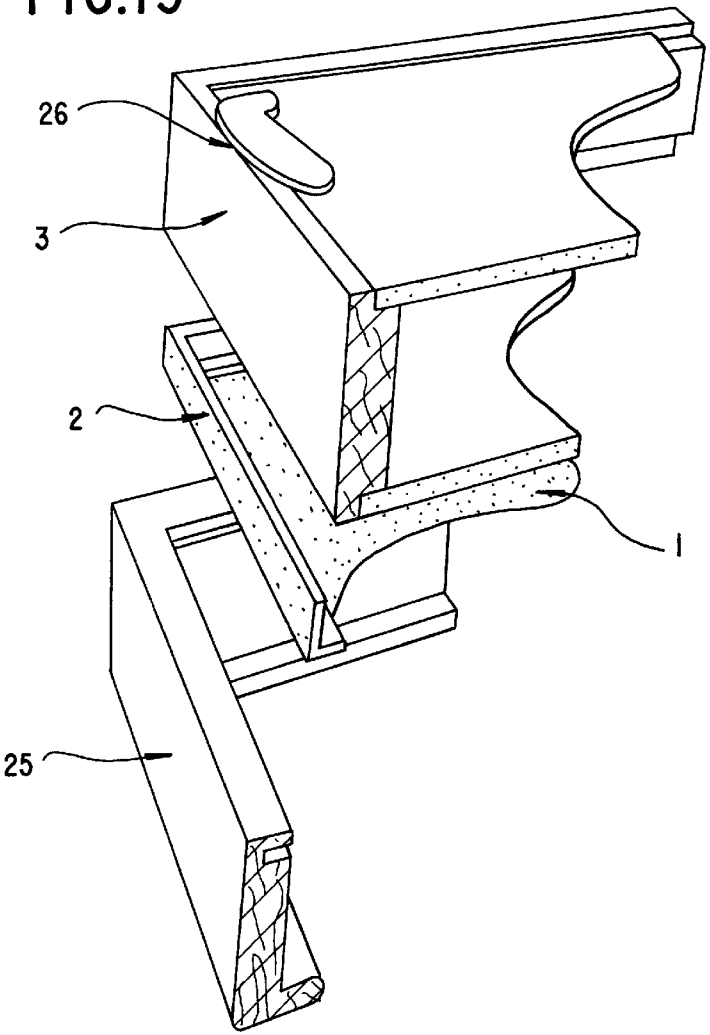
Figure 18:
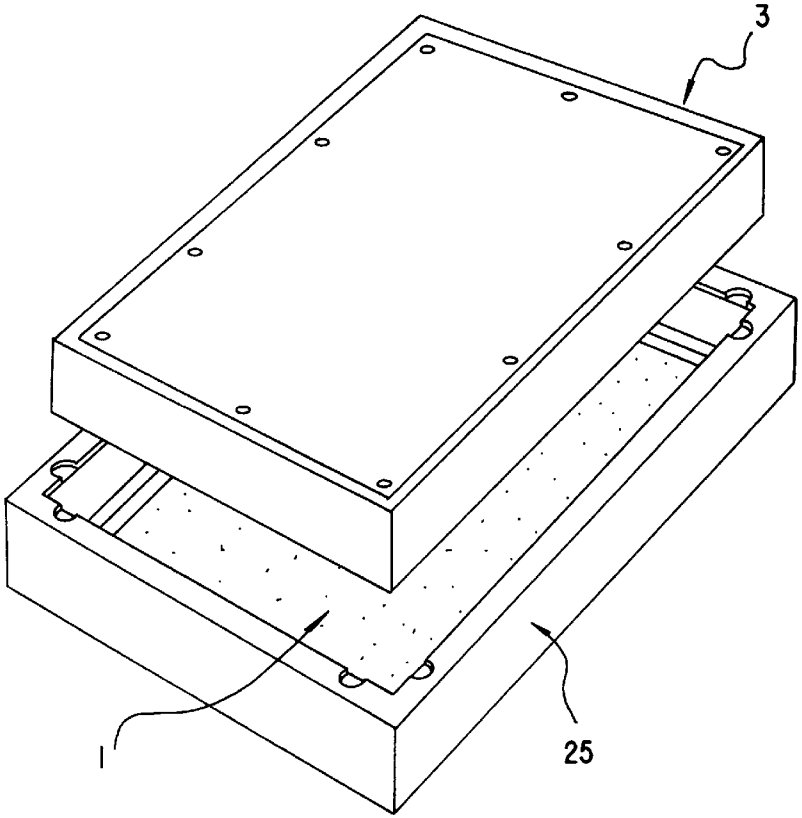

In FIGS. 17, 18, and 19, the speaker cover is placed in the picture frame 25. The loudspeaker cabinet 3 is then placed in the picture frame 25, and the assembly is secured using a fastening mechanism 26.

If the loudspeaker is an in-wall or ceiling type, the decorative speaker cover does not have to be attached. The decorative speaker cover can merely be placed over the loudspeaker.

It is to be understood that every aspect of the present invention has not been described explicitly. Thus, certain modifications of the invention that are not explicitly described are fully comprehended by the spirit of the invention and the scope of the claims set forth below.

What is claimed is:

1. A decorative cover for a loudspeaker cabinet, comprising:

a support frame; and a sheet of substantially acoustically transparent material which contains an artistic work stretched across and adhered to said support frame; and means for readily attaching and detaching the decorative cover to the loudspeaker cabinet.

2. A decorative cover according to claim 1 wherein said sheet of substantially acoustically transparent material is made of synthetic silk, chemically treated synthetic silk, ScotchPrint™ perforated vinyl film, or ScotchPrint™ vinyl film.

3. A decorative cover according to claim 1 wherein the decorative cover further comprises a picture frame that receives said support frame, wherein the picture frame is capable of being readily attached to and detached from the loudspeaker cabinet.

4. A decorative speaker cover according to claim 1 wherein said means for readily attaching and detaching comprises male receptors that fit into female receptacles on the loudspeaker cabinet.

5. A decorative speaker cover according to claim 1 wherein said means for readily attaching and detaching comprises an extruded spring that slides into a reveal in the loudspeaker cabinet.

6. A decorative speaker cover according to claim 1 wherein the loudspeaker cabinet comprises a door or panel in an entertainment center.

7. The decorative cover according to claim 1 wherein a picture frame is integrated into the loudspeaker cabinet to yield an integrated picture frame/cabinet structure to which the support frame can be readily attached to and detached from.

8. The decorative cover according to claim 7 wherein the integrated picture frame/cabinet structure further comprises a removable portion to which the support frame can be readily attached to and detached from.

9. A method for making a decorative cover for a loudspeaker cabinet comprising the steps of:

transferring an image on to a sheet of substantially acoustically transparent material;

stretching the sheet of substantially acoustically transparent material across a support frame;

adhering the sheet of substantially acoustically transparent material to the support frame; and configuring the support frame to readily attach and detach the support frame to the loudspeaker cabinet.

10. A method for readily attaching and detaching a decorative cover to a loudspeaker cabinet, comprising:

altering a support frame, across which a sheet of substantially acoustically transparent material is stretched and adhered to, to be readily attachable and detachable from the loudspeaker cabinet;

altering the loudspeaker cabinet to permit the support frame to be readily attached and detached to the loudspeaker cabinet; and securing the support frame to the loudspeaker cabinet.

11. A method according to claim 10 further comprising the step of placing a scrim cloth between the decorative speaker cover and the loudspeaker cabinet before securing the support frame to the loudspeaker cabinet.

12. A method according to claim 10 where altering the support frame involves placing metal strips on the support frame of the decorative speaker cover.

13. A method according to claim 10 where altering the loudspeaker cabinet involves attaching magnets to the loudspeaker cabinet.

14. A method according to claim 10 where altering the support frame involves placing metal strips on the support frame, altering the loudspeaker cabinet involves placing magnets on the loudspeaker cabinet, and securing the support frame to the loudspeaker cabinet involves causing the metal strips on the support frame to make contact with the magnets on the loudspeaker cabinet.

15. A method according to claim 10 where altering the support frame involves adding injection molded pieces to the support frame.

16. A method according to claim 10 where altering the loudspeaker cabinet involves adding female receptacles to the loudspeaker cabinet.

17. A method according to claim 10 where altering the support frame involves pressing molded pieces on the support frame, altering the loudspeaker cabinet involves putting female receptacles on the loudspeaker cabinet, and securing the support frame to the loudspeaker cabinet involves pressing the molded pieces on the support frame into the female receptacles on the loudspeaker cabinet.

18. A method according to claim 10 where altering the support frame involves including an extruded spring to the support frame.

19. A method according to claim 10 where altering the loudspeaker cabinet involves adding a reveal to the loudspeaker cabinet.

20. A method according to claim 10 where altering the support frame involves pressing an extruded spring on the support frame, altering the loudspeaker cabinet involves placing a reveal on the loudspeaker cabinet, and securing the support frame to the loudspeaker cabinet involves pressing the extruded spring on the support frame into the reveal on the loudspeaker cabinet.

21. A method according to claim 10 where altering the support frame involves adding integrated fasteners to the support frame.

22. A method according to claim 10 where altering the loudspeaker cabinet involves adding slots and holes to the loudspeaker cabinet.

23. A method according to claim 10 where altering the support frame involves placing integrated fasteners in the support frame, altering the loudspeaker cabinet involves placing slots in the loudspeaker cabinet that line up with the integrated fasteners in the support frame, and securing the support frame to the loudspeaker cabinet involves appropriately placing the speaker cover in the loudspeaker cabinet so the slots in the loudspeaker cabinet lock in the support frame and then turning the integrated fasteners in the support frame into the holes in the loudspeaker cabinet.

24. The method of claim 10, further comprising:

detaching the support frame from the loudspeaker cabinet.

25. A method for attaching a decorative cover to a loudspeaker cabinet, comprising the steps of:

placing the support frame of a decorative speaker cover in a picture frame, wherein a sheet of substantially acoustically transparent material is stretched across and adhered to the support frame and wherein the picture frame is configured to be readily attached and detached from the loudspeaker cabinet using a fastening mechanism; and securing the picture frame to a loudspeaker cabinet using the fastening mechanism.

26. The method of claim 25, further comprising:

detaching the picture frame from the loudspeaker cabinet using the fastening device.

27. A decorative loudspeaker assembly, comprising:

a decorative cover for a loudspeaker cabinet, comprising:
- a support frame; and
- a sheet of substantially acoustically transparent material that contains an artistic work stretched across and adhered to said support frame;

a loudspeaker cabinet; and means for readily attaching and detaching the decorative cover to the loudspeaker cabinet.

28. A decorative loudspeaker assembly, comprising:

a loudspeaker cabinet;

a picture frame;

a decorative cover for the loudspeaker cabinet that is positioned between the loudspeaker cabinet and the picture frame, comprising:
- a support frame; and
- a sheet of substantially acoustically transparent material which contains an artistic work stretched across and adhered to said support frame; and means for readily attaching and detaching the picture frame to the loudspeaker cabinet.

29. A decorative loudspeaker assembly, comprising:

a decorative cover for the loudspeaker cabinet that is positioned between the loudspeaker cabinet and the picture frame, comprising:
- a support frame; and
- a sheet of substantially acoustically transparent material which contains an artistic work stretched across and adhered to said support frame; and an integrated picture frame/cabinet structure, comprising:
- a loudspeaker cabinet;
- a picture frame integrated into the loudspeaker cabinet; and
- a removable portion that is attached to the decorative cover, wherein the decorative cover is readily attached to the loudspeaker by pressing the removable portion into the integrated picture frame/cabinet structure and readily detached from the loudspeaker by removing the removable portion from the integrated picture frame/cabinet structure.

30. A decorative loudspeaker assembly, comprising:

a decorative cover for a loudspeaker cabinet, comprising:
- a support frame; and
- a sheet of substantially acoustically transparent material that contains an artistic work stretched across and adhered to said support frame;

a loudspeaker cabinet;

a picture frame into which the decorative cover and the loudspeaker cabinet are placed; and means for readily securing the decorative cover and the loudspeaker cabinet into the picture frame and for readily removing the decorative cover and the loudspeaker cabinet from the picture frame.

* * * * *